US006705235B1

(12) United States Patent
Gerutto

(10) Patent No.: US 6,705,235 B1
(45) Date of Patent: Mar. 16, 2004

(54) ATTACHABLE PLATFORM FOR AN OPEN CONTAINER AND METHOD OF USE

(76) Inventor: Mike Gerutto, 4321 Atlantic Ave., Long Beach, CA (US) 90807

( * ) Notice: Subject to any disclaimer, the term of this patent is extended or adjusted under 35 U.S.C. 154(b) by 0 days.

(21) Appl. No.: 10/211,054

(22) Filed: Aug. 5, 2002

(51) Int. Cl.[7] ..... A47B 5/00
(52) U.S. Cl. ..... 108/47; 108/152
(58) Field of Search ..... 108/42, 47, 152; 248/215, 220.1, 222.12, 235, 240, 241, 2

(56) References Cited

U.S. PATENT DOCUMENTS

| | | | | | |
|---|---|---|---|---|---|
| 1,174,755 | A | * | 3/1916 | Mullen | 4/579 |
| 2,720,436 | A | * | 10/1955 | Covey | 297/163 |
| 2,787,508 | A | * | 4/1957 | Math | 297/163 |
| 2,798,780 | A | * | 7/1957 | Motorney | 297/163 |
| 3,125,040 | A | * | 3/1964 | Roberson | 108/18 |
| 4,113,058 | A | * | 9/1978 | Kobosh | 182/187 |
| 5,148,755 | A | * | 9/1992 | Morales | 108/47 |
| 6,026,601 | A | * | 2/2000 | Kiel | 38/137 |
| 6,343,834 | B1 | * | 2/2002 | Wurmlinger | 297/14 |
| 6,474,244 | B1 | * | 11/2002 | Karpinski | 108/42 |

FOREIGN PATENT DOCUMENTS

JP 3-2727708 * 12/1991

* cited by examiner

*Primary Examiner*—Jose V. Chen
(74) *Attorney, Agent, or Firm*—Timothy Thut Tyson; Ted Masters; Freilich, Hornbaker & Rosen

(57) ABSTRACT

A platform is selectively attachable to the wall of an open container. The platform includes a hanger which is placed over and engages the top rim of the container wall. A bracket is pivotal between a flat storage position and a locked position perpendicular to the planar body of the platform. When the bracket is placed in the locked perpendicular position, the hanger may be placed over the top rim of the upstanding wall so that the bracket abuts the outside surface of the upstanding wall and the platform is therefore maintained in a substantially horizontal orientation.

6 Claims, 6 Drawing Sheets

Fig. 1
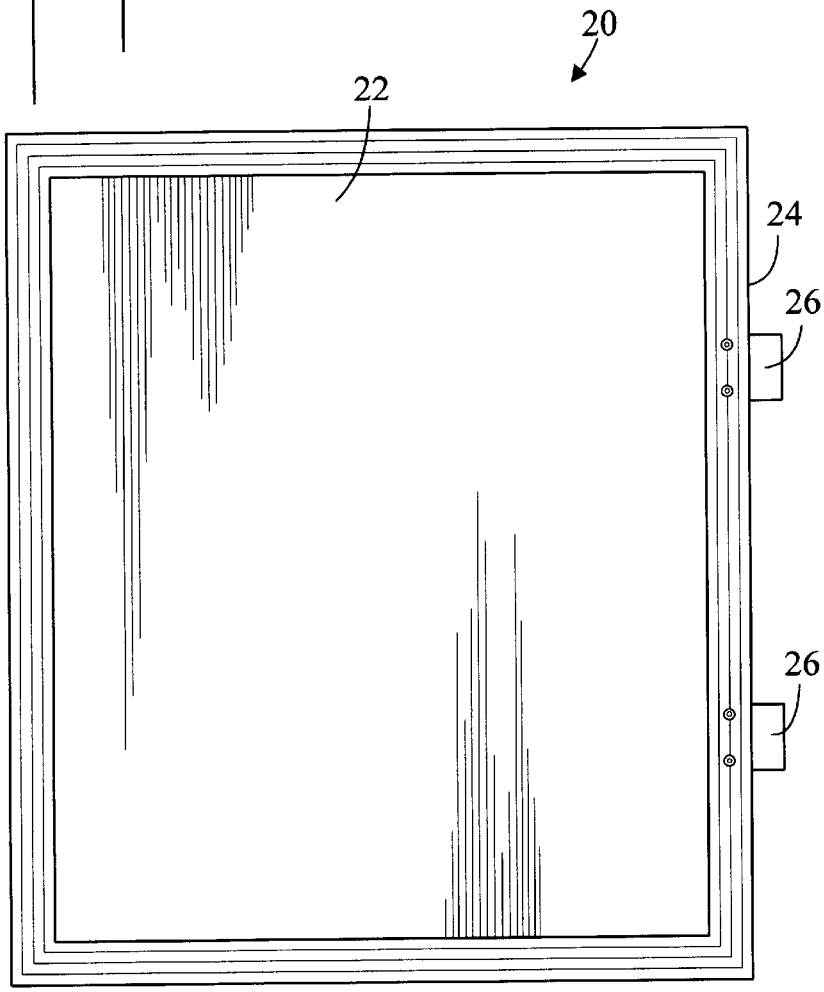
Fig. 3
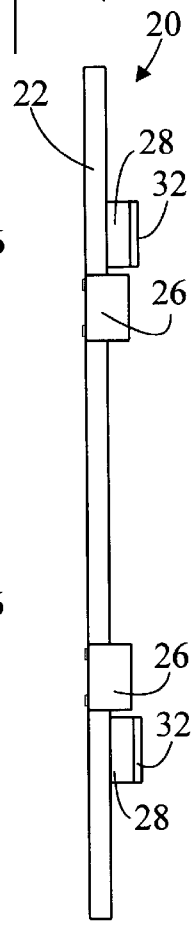
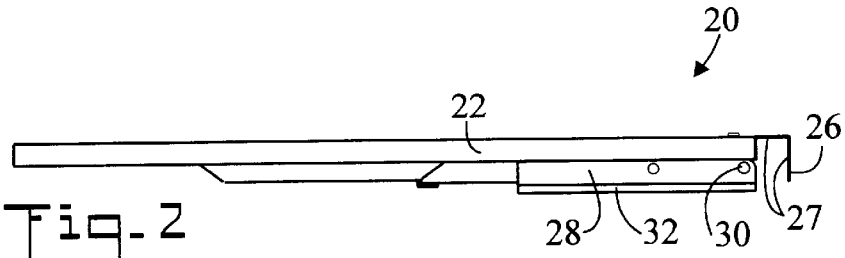
Fig. 2

Fig. 9
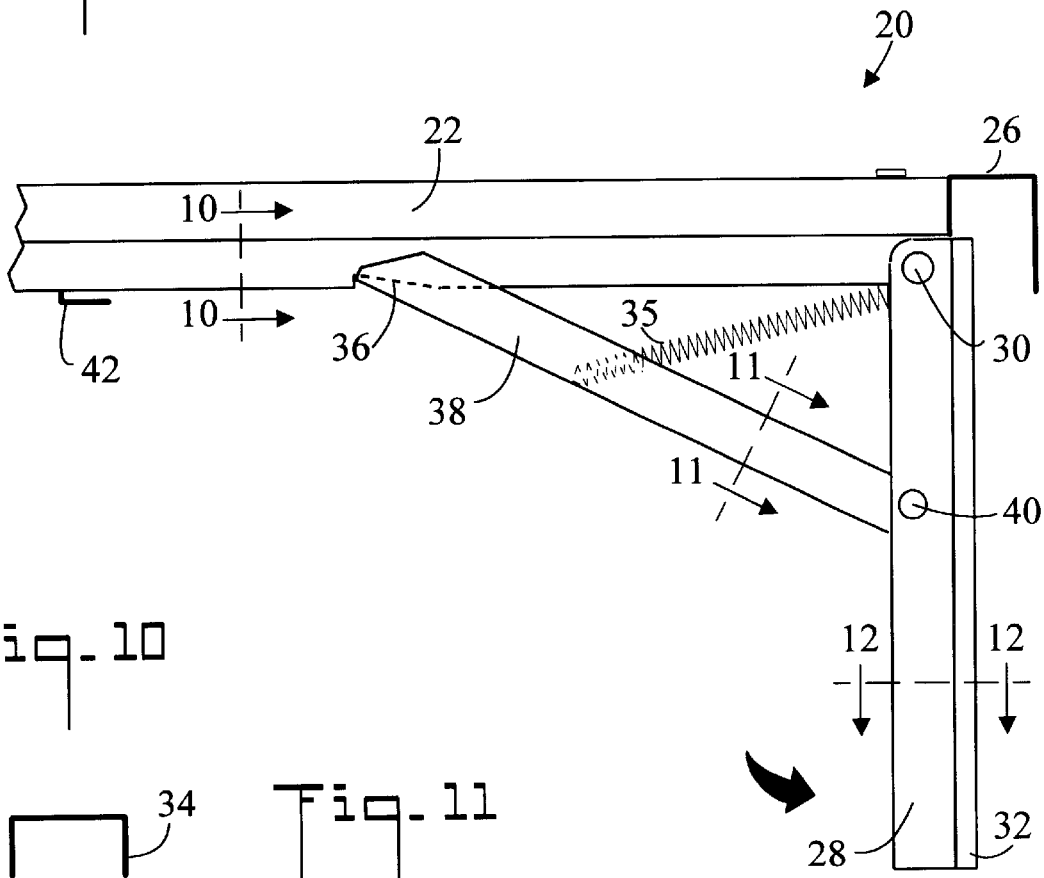
Fig. 10
Fig. 11
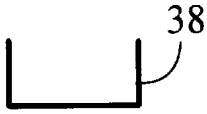
Fig. 12
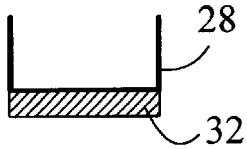

ATTACHABLE PLATFORM FOR AN OPEN CONTAINER AND METHOD OF USE

TECHNICAL FIELD

The present invention pertains generally to cases and containers for transporting various products such as electronics, and more particularly to a platform which may be attached to the top of an open container in order to provide a convenient horizontal workspace.

BACKGROUND OF THE INVENTION

Containers and cases for transporting products are well known in the art. For example, U.S. Pat. No. 2,609,072 shows a folding table or the like. The folding table includes two slidable extension panels.

U.S. Pat. No. 4,595,086 illustrates a portable desk-work bench with carrying case. The device has a top unit defining an upper work surface and having front, rear, and opposite side marginal portions. A downwardly opening cover also having front, rear, and opposite side marginal portions is provided and the rear marginal portion of the cover is pivotally supported from the rear marginal portion of the top unit for swinging about an axis generally paralleling the rear marginal portions between a closed position closely telescopingly engaged over the top unit from above and an open position extending upwardly from the rear marginal portion of the top unit. Also, the cover is supported for shifting of the cover, after it has been swung to the open position, relative to the axis of rotation of the cover relative to the top unit, along a path extending between the front and, rear marginal portions of the cover to a position with the axis closely adjacent the front marginal portion of the cover and the cover disposed at generally right angles relative to the top unit, having its front marginal portion disposed to the rear of the top unit rear marginal portion and the rear marginal portion of the top unit lowermost. Short and long front and rear leg assemblies are stored within downwardly opening center and opposite side compartments defined by the top unit and the latter includes a bottom panel hingedly supported from the lower rear marginal portion thereof for swinging between a depending open position and a closed position closing the compartments from below.

U.S. Pat. No. 4,856,627 discloses a work bench and table system. The system includes a combination briefcase and table arrangement having a set of telescoping legs mounted at the underside of a briefcase body, so that the legs support the briefcase a certain height above a floor surface when the legs are extended. The legs are stored in recessed compartments that open at the underside of the briefcase body. A set of shelves are supported in a cover portion of the briefcase, for sliding movement between a withdrawn position at which the shelves are concealed inside the cover portion, and a working position at which the shelves project from the cover portion in a plane parallel with a top surface of the cover portion. The projecting shelves and the cover portion together define a flat table surface on which papers, tools, instruments and the like carried in the briefcase, can be placed at a work site.

U.S. Pat. No. 4,874,119 comprises a tool pack apparatus having a shape retaining shell enclosing a tool protective compartment. The shell includes first and second door members and a lid member which can pivot from a closed position, backward, to an open position. When the door and lid members are in the open position, the door members can be attached to the lid member to form a rigid structure. When in the open position and attached, the base of the door members prevents the pack from tipping backward and an inside surface of the lid member provides a stable work surface. The tool pack includes a removable shelf member and a small shelf pouch which can be attached to the shelf member. The shelf member may be installed in the tool protective compartment in a first position to form an open-ended cell for confinement of objects stored beneath the shelf or installed in a second position in which the space beneath the shelf is readily accessible.

The shelf pouch has a base panel with a dimension larger than a dimension of the shelf member and means for releasably attaching edges of the base panel adjacent edges of a shelf surface so that objects can be stored beneath the base of the shelf pouch when it is attached to the shelf member.

U.S. Pat. No. 4,986,395 consists of a combined suitcase and portable ironing board comprising a pair of suitcase sections each including a closed end surrounded by side walls and an open end. The suitcase sections are pivotably connected to one another along a side wall of each section so that the sections can be pivoted away from each other to an open position with the closed ends in the same plane forming an elongated, contiguous, substantially flat ironing board surface. A panel extends outwardly from the side wall of one suitcase section opposite the side wall which is pivotably connected to the other suitcase section and has a substantially flat surface lying in substantially the same plane as the closed ends forming an extension of the ironing board surface. Means are provided for supporting the panel in its outwardly extending position and for retracting the pane, through an opening in the side wall when the panel is not in use.

U.S. Pat. No. 5,437,367 describes a carrying case for electronic components such as a lap top computer, printer, CD ROM, and the like. The case has a first shell half and a second shell half-connected along a hinged edge. The first shell half has two shelves foldable from a stowed position lying parallel to the plane of the first shell to a use position perpendicular to the shell. The shelves are lockable in the use position.

U.S. Pat. No. 5,518,258 depicts a compact portable workstation designed for the tradesman and the home person. In the closed position, the workstation is small enough to transport by car. In the open position, the workstation provides a large work space. The workstation totes like an upright dolly and features two independent work surfaces each which hinge atop the workstation and have folding legs. A middle leaf of the extended work surface doubles as a collapsible stool. Three storage drawers are accessable from both sides. On top is an open bin. The stool is stored in the upper bin and functions as the middle leaf. When the legs are folded, they are hidden except the ends which function as handles.

SUMMARY OF THE INVENTION

The present invention is directed to a platform which attaches to the wall of an open container or case, and a method for attaching same. The platform hangs off of the container wall and provides a useful horizontal workspace. In a preferred embodiment, the present invention is utilized with electronic equipment cases, however the principles of the present invention may be applied to other types of cases as well. A preferred name for the present invention is a "wing".

In accordance with a preferred embodiment of the invention, a platform selectively attaches to the upstanding wall of an open container or a closed container *having slots at the top of an upstanding wall such as an electronic equipment case. A hanger is located on the perimeter of the platform, and is shaped to receive and engage the top rim of the upstanding wall. A bracket is pivotally attached to the platform, and locks in a perpendicular position. With the bracket in the perpendicular position, the hanger is placed over the top rim of the upstanding wall with the bracket in abutting relationship with the outside surface of the upstanding wall. When so positioned, the platform extends horizontally outward to form a useful work or storage surface.

In accordance with an important aspect of the invention, the platform has an underside having a longitudinal member which has a notch. A spring-loaded brace is pivotally connected to the bracket, so that the brace may be selectively locked into position between the bracket and the notch, thereby locking the bracket perpendicular to the platform.

In accordance with an important feature of the invention, both the bracket and the brace are pivotable into a storage position where they reside parallel to the underside of the platform.

In accordance with another important aspect of the invention, a cushioning material is disposed on one side of the bracket, so that when the platform is installed on the upstanding wall, the cushioning material is located between the bracket and the, outside surface of the wall.

In accordance with another important feature of the invention, a cushioning material is also disposed on the inside of the hanger.

Other features and advantages of the present invention will become apparent from the following detailed description, taken in conjunction with the accompanying drawings, which illustrate, by way of example, the principles of the invention.

BRIEF DESCRIPTION OF THE DRAWINGS

FIG. 1 is a top plan view of an attachable platform for an open container in accordance with the present invention;

FIG. 2 is an end elevation view of the platform;

FIG. 3 is a side elevation view of the platform;

FIG. 9 is an enlarged side elevation view of the bracket in the perpendicular position;

FIG. 10 is an enlarged cross sectional view along the line 10—10 of FIG. 9;

FIG. 11 is an enlarged cross sectional view along the line 11—11 of FIG. 9;

FIG. 12 is an enlarged cross sectional view along the line 12—12 of FIG. 9;

DETAILED DESCRIPTION OF THE INVENTION

Figure 4:
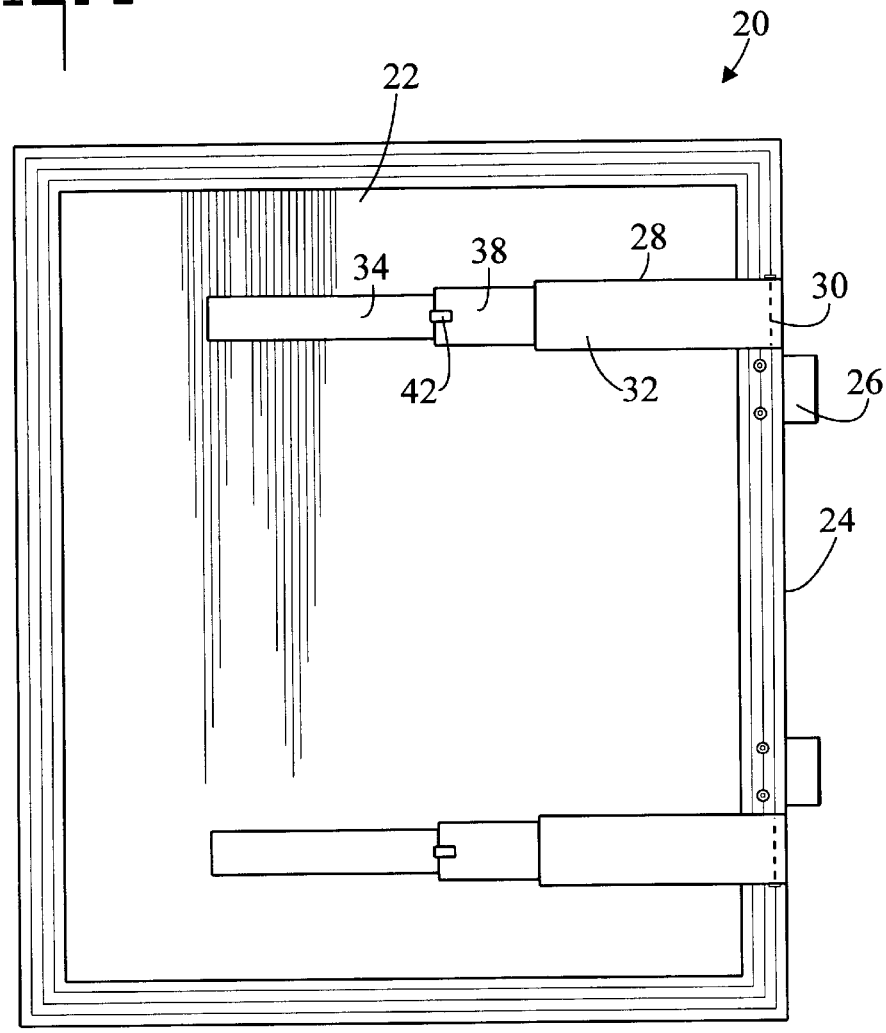
FIG. 4 is a bottom plan view of the platform.

Referring initially to FIGS. 1–4 and 15, there are illustrated top plan, end elevation, side elevation, bottom plan, and perspective views, respectively, of an attachable platform for an open container in accordance with the present invention, generally designated as 20. Open container or case 500 has an upstanding wall 502 having a top rim 504 and an outer surface 506. Platform 20 includes a substantially planar body 22, having a perimeter 24. At least one hanger 26 (two in the shown preferred embodiment) is disposed along perimeter 24. Hanger 26 is shaped and dimensioned to be placed over and receive top rim 504 of upstanding wall 502 of open container 500. In a preferred embodiment, a cushioning material 27 is disposed on the inside of hanger 26, so that hanger 26 will not abrade top rim 504.

It will be appreciated that attachable platform 20 may also be used on a closed container having slots at the top of an upstanding wall spaced to receive the hangers 26.

At least one pivotable bracket 28 (two in the shown preferred embodiment) is connected to body 22, wherein bracket 28 pivots between a position parallel to body 22 (refer to FIGS. 2 and 6), to a locked position perpendicular to body 22 (refer to FIGS. 5, 9, 13, and 14). As used herein, locked means that bracket 28 is prevented from pivoting toward its stored position (refer to FIG. 6). Bracket 28 is pivotally attached to body 22 at 30. A cushioning material 32 is disposed on one side of bracket 28, so that when platform 20 is installed on upstanding wall 502, cushioning material 32 (such as foam rubber) is disposed between bracket 28 and outside surface 506 of upstanding wall 502 (refer also to FIGS. 13 and 14). Cushioning material 32 thereby prevents abrasions to outside surface 506.

Figure 5:
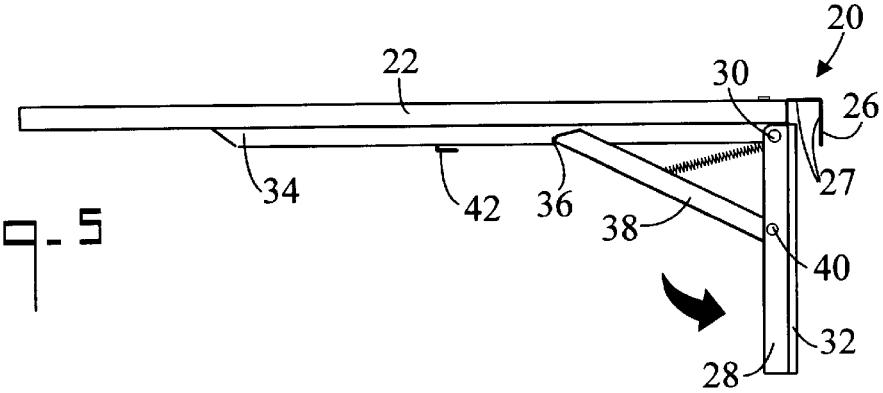
FIG. 5 is a side elevation view of the platform with a bracket pivoted to a position perpendicular to the platform.

FIG. 5 is a side elevation view of platform 20 with bracket 28 pivoted to a locked position perpendicular to platform 20. When bracket 28 is in the locked position perpendicular to body 22, hanger 26 may be placed over top rim 502 of upstanding wall 502 (refer also to FIGS. 13 and 14) so that bracket 28 abuts outside surface 506 of upstanding wall 502, and platform 20 resides in a substantially horizontal orientation. Body 22 has an underside having a longitudinal member 34 having a notch 36 (also refer to FIG. 8). A spring-loaded brace 38 is pivotally connected to bracket 28 at 40. Brace 38 may be selectively locked into position between bracket 28 and notch 36 so that bracket 28 is locked perpendicular to body 22 of platform 20.

It will be appreciated that a brace such as brace 38 may be held in position by a means other than spring 35 such as a hydraulic cylinder.

Figure 6:
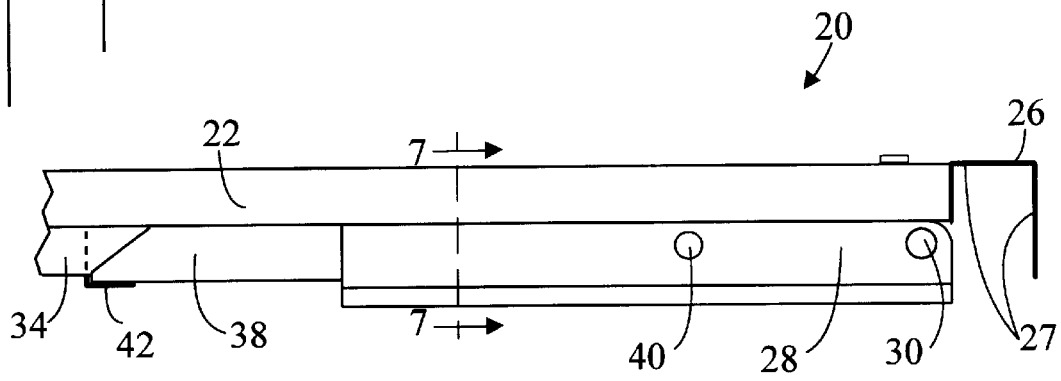
FIG. 6 is an enlarged side elevation view of the bracket in a storage position.

FIG. 6 is an enlarged side elevation view of bracket 28 in a storage position. Bracket 28 and brace 38 have been pivoted into a storage position parallel to body 22. A retainer 42 is attached to longitudinal member 34. Retainer 42 holds brace 38 in the storage position.

Figure 7:
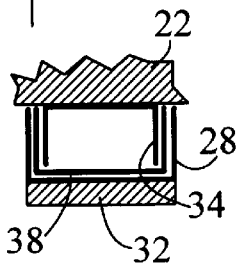
FIG. 7 is an enlarged cross sectional view along the line 7—7 of FIG. 6.

FIG. 7 is an enlarged cross sectional view along the line 7—7 of FIG. 6. It may be seen that in the storage position, longitudinal member 34, brace 38, and bracket 28 comprise a nested group of channel shaped members.

Figure 8:
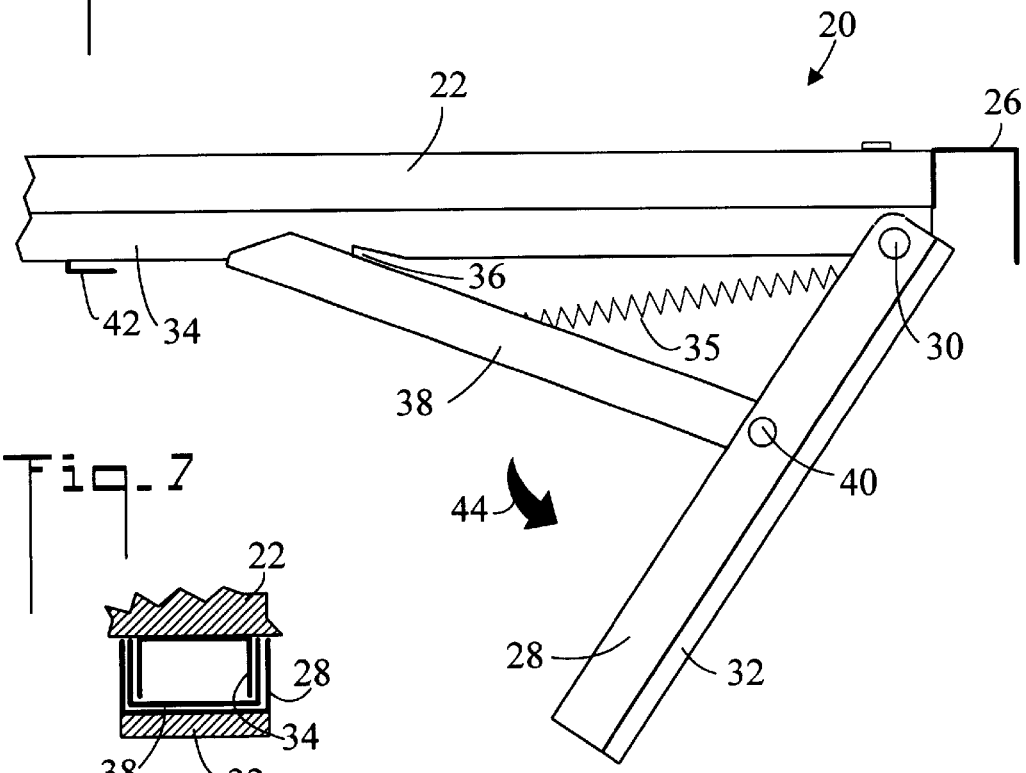
FIG. 8 is an enlarged side elevation view of the bracket being pivoted from the storage position toward a perpendicular position.

FIG. 8 is an enlarged side elevation view of bracket 28 being pivoted in direction 44 from the storage position of FIG. 6 toward a perpendicular position of FIG. 9. Spring 35, connected between brace 38 and bracket 28 serves in an "over the center" fashion to bias brace 38 to either the flat storage position of FIG. 6 or the perpendicular position of FIG. 9.

FIG. 9 is an enlarged side elevation view of bracket 28 in the perpendicular ready for use position.

FIG. 10 is an enlarged cross sectional view along the line 10—10 of FIG. 9;

FIG. 11 is an enlarged cross sectional view along the line 11—11 of FIG. 9;

FIG. 12 is an enlarged cross sectional view along the line 12—12 of FIG. 9

Figure 13:
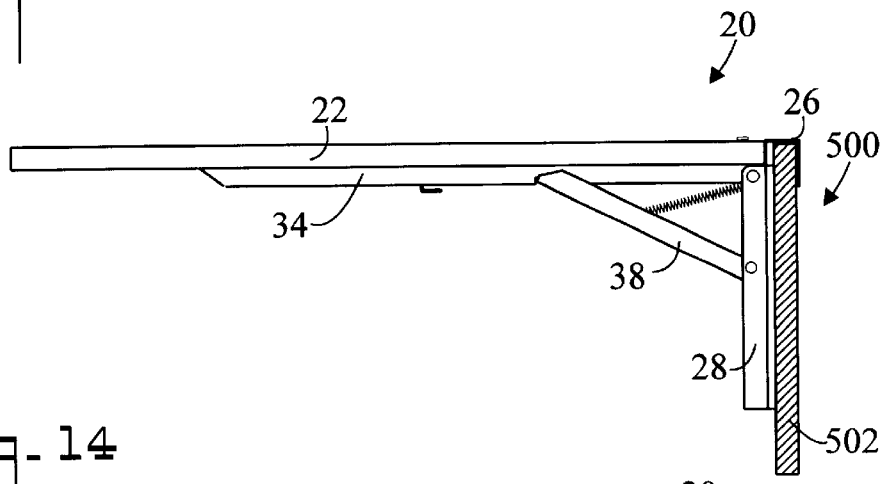
FIG. 13 is a side elevation view showing the bracket in the perpendicular position, and the platform installed on an upstanding wall of an open container.

FIG. 13 is a side elevation view showing bracket 28 in the perpendicular position, and the platform installed on an upstanding wall of an open container.

Figure 14:
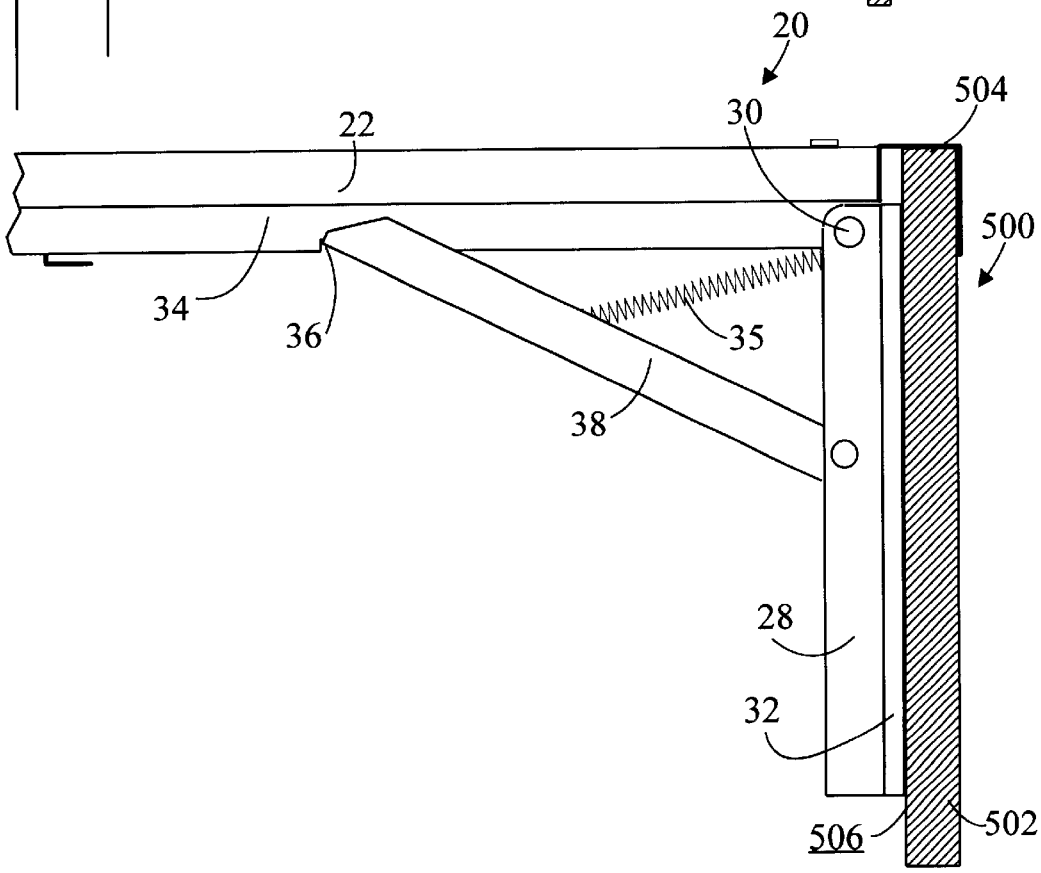
FIG. 14 is an enlarged side elevation view showing the bracket in the perpendicular position, and the platform installed on the upstanding wall of the open container; and, FIG. 15 is a reduced perspective view of the platform installed on an open container.

FIG. 14 is an enlarged side elevation view showing bracket 28 in the perpendicular position, and platform 500 installed on upstanding wall 502 of open container 500.

Figure 15:
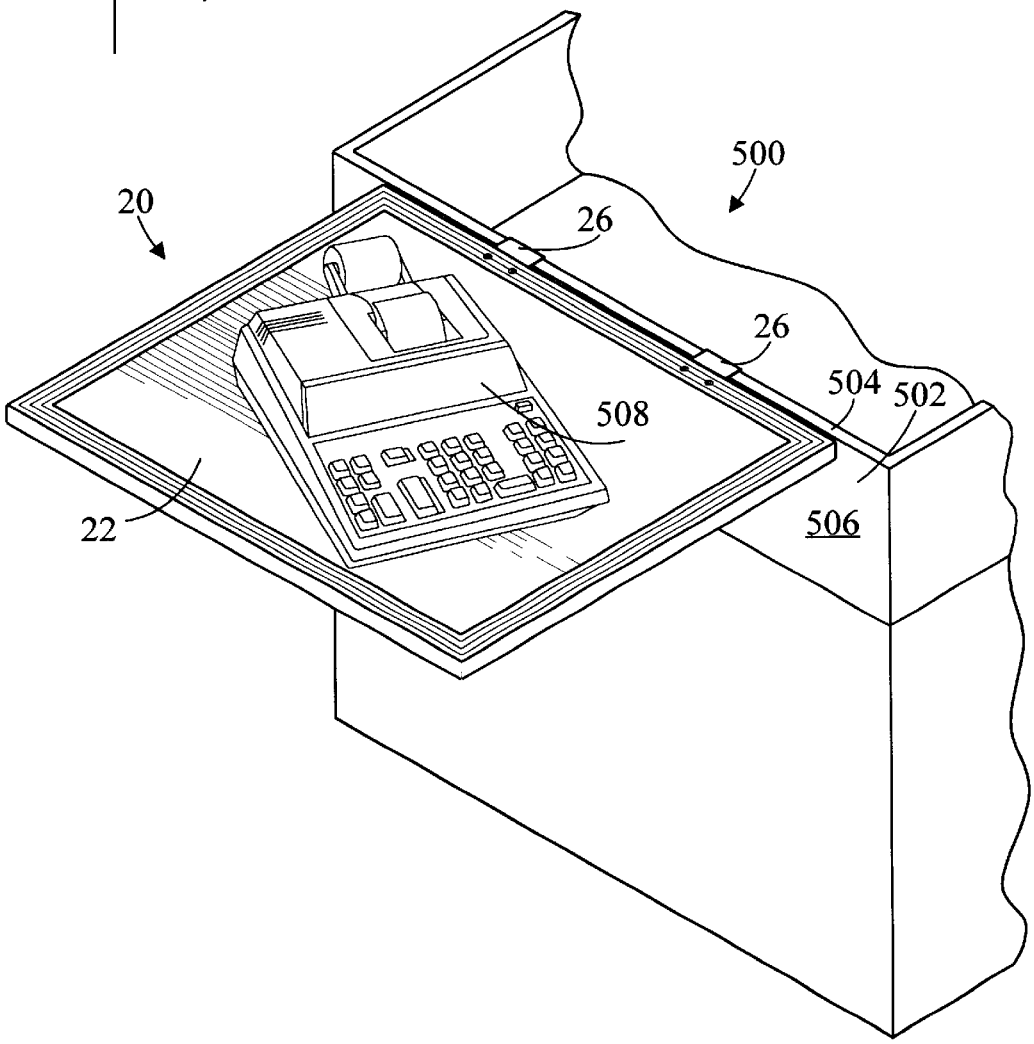

FIG. 15 is a reduced perspective view of platform 20 installed on open container 500. An object 508 has been placed on platform 20.

In terms of use, a method for providing a horizontal workspace, includes:

(a) providing an open container 500 having an upstanding wall 502 having a top rim 504 and an outside surface 506;

(b) providing an attachable platform 20 for the open container 500, the platform 20 including:

a substantially planar body 22 having a perimeter 24;

at least one hanger 26 disposed along perimeter 24, hanger 26 shaped and dimensioned to receive top rim 504 of upstanding wall 502; and, at least one pivotable bracket 28 connected to body 22, wherein the bracket 28 pivots between a storage position parallel to body 22, to a locked ready for use position perpendicular to body 22;

(c) locking bracket 28 into the position perpendicular to body 22; and, (d) placing hanger 26 over top rim 504 of upstanding wall 502 so that bracket 28 abuts outside surface 506 of upstanding wall 502, and platform 20 resides in a substantially horizontal orientation.

The method further including:

in step (b) platform 20 further including:

body 22 having an underside;

a longitudinal member 34 disposed on the underside, longitudinal member 34 having a notch 36; and, a spring-loaded brace 38 pivotally connected to bracket 28; and, in step (c), the locking operation including causing brace 38 to be locked into a position between bracket 28 and notch 36 of longitudinal member 34.

The method further including:

removing platform 20 from open container 500 and pivoting bracket 28 and brace 38 into a storage position parallel to body 22.

The method further including:

in step (b), a cushioning material 32 disposed on one side of bracket 28 so that in step (d) cushioning material 32 is disposed between bracket 28 and outside surface 506.

The method further including:

in step (b), a cushioning material 27 disposed on the inside of hanger 26.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A method for providing a horizontal workspace, comprising:

(a) providing an open container having an upstanding wall having a top rim and an outside surface;

(b) providing an attachable platform for said open container said platform including:

a substantially planar body having a perimeter and an underside;

at least one hanger disposed along said perimeter, said hanger shaped and dimensioned to receive said top rim of said upstanding wall;

at least one pivotable bracket connected to said body, wherein said bracket pivots between a position parallel to said body, to a locked position perpendicular to said body;

a longitudinal member disposed on said underside, said longitudinal member having a notch and a retainer; and, a spring-loaded brace pivotally connected to said bracket;

(c) locking said bracket into said position perpendicular to said body by causing said brace to be locked into position between said bracket and said notch;

(d) placing said hanger over said top rim of said upstanding wall so that said bracket abuts said outside surface of said upstanding wall, and said platform resides in a substantially horizontal orientation; and, (e) removing said platform from said open container and pivoting said bracket and said brace into a storage position parallel to said body with said retainer holding said brace.

2. The method of claim 1, further including:

in step (b), a cushioning material disposed on one side of said bracket so that in step (d) said cushioning material is disposed between said bracket and said outside surface.

3. The method of claim 1, further including:

in step (b), a cushioning material disposed on an inside of said hanger.

4. An attachable platform for an open container, the open container having an upstanding wall having a top rim and an outside surface, said platform comprising:

a substantially planar body having a perimeter and an underside;

at least one hanger disposed along said perimeter, said hanger shaped and dimensioned to receive the top rim of the upstanding wall;

at least one pivotable bracket connected to said body, wherein said bracket pivots between a position parallel to said body, to a locked position perpendicular to said body;

a longitudinal member disposed on said underside, said longitudinal member having a notch and a retainer; and, a spring-loaded brace pivotally connected to said bracket;

wherein said brace may be selectively locked into position between said bracket and said notch so that said bracket is perpendicular to said body and when said bracket is in said locked position perpendicular to said body, said hanger may be placed over the top rim of the upstanding wall so that said bracket abuts the outside surface of the upstanding wall, and said platform resides in a substantially horizontal orientation; and, wherein said bracket and said brace may be selectively pivoted and locked into a storage position parallel to said body with said retainer holding said brace when said platform is removed from the upstanding wall.

5. A platform according to claim 4, further including:

a cushioning material disposed on one side of said bracket, so that when said platform is installed on the upstanding wall, said cushioning material is disposed between said bracket and the outside surface.

6. A platform according to claim 4, further including:

a cushioning material disposed on an inside of said hangar.

* * * * *